US007364487B2

(12) United States Patent
Evans et al.

(10) Patent No.: US 7,364,487 B2
(45) Date of Patent: Apr. 29, 2008

(54) STRUCTURE BUILDING TOY

(75) Inventors: Ross Evans, North San Juan, CA (US); Adam Tobin, Oakland, CA (US); Adam DeVito, San Francisco, CA (US); Quillon Tsang, Sausalito, CA (US); Joel Shrock, Berkeley, CA (US)

(73) Assignee: Cranium, Inc., Seattle, WA (US)

( * ) Notice: Subject to any disclaimer, the term of this patent is extended or adjusted under 35 U.S.C. 154(b) by 0 days.

(21) Appl. No.: 11/251,424

(22) Filed: Oct. 13, 2005

(65) Prior Publication Data

US 2006/0135033 A1 Jun. 22, 2006

Related U.S. Application Data

(60) Provisional application No. 60/619,260, filed on Oct. 15, 2004.

(51) Int. Cl.
*A63H 33/08* (2006.01)

(52) U.S. Cl. ..... 446/108; 446/118; 446/124; 446/476; 446/478

(58) Field of Classification Search ..... 446/92, 446/108, 110, 118, 119, 120, 124–128, 476, 446/478; 482/35
See application file for complete search history.

(56) References Cited

U.S. PATENT DOCUMENTS

| | | | | |
|---|---|---|---|---|
| 2,193,469 | A | | 3/1940 | Ashton |
| 2,758,494 | A | | 8/1956 | Jenkins |
| 2,970,388 | A | | 2/1961 | Yonkers |
| 2,983,071 | A | | 5/1961 | Oliver |
| 3,300,891 | A | * | 1/1967 | Glass et al. ..... 446/97 |
| 3,452,989 | A | * | 7/1969 | Jernstrom ..... 273/276 |
| 3,518,786 | A | | 7/1970 | Holtvoigt |
| 3,564,759 | A | | 2/1971 | Buttermore |
| 3,638,602 | A | | 2/1972 | Carreno |
| 3,699,704 | A | | 10/1972 | Hakim |
| 3,731,420 | A | | 5/1973 | Crosman |
| 3,832,799 | A | | 9/1974 | Vennola |
| 3,960,161 | A | | 6/1976 | Norman |
| 4,020,566 | A | | 5/1977 | Dreiding |
| 4,030,209 | A | | 6/1977 | Dreiding |
| 4,147,344 | A | | 4/1979 | Lee |
| 4,184,271 | A | | 1/1980 | Barnett, Jr. |
| 4,188,745 | A | | 2/1980 | Harvey et al. |
| 4,197,681 | A | | 4/1980 | Holcombe |
| 4,207,696 | A | | 6/1980 | Hyman et al. |
| 4,335,538 | A | | 6/1982 | Greenberg |
| 4,363,181 | A | | 12/1982 | Hyman et al. |
| D272,168 | S | | 1/1984 | Sielaff |
| 4,479,329 | A | | 10/1984 | Fraden |

(Continued)

FOREIGN PATENT DOCUMENTS

| | | |
|---|---|---|
| EP | 356626 A1 | 3/1990 |
| JP | 7-47176 A | 2/1995 |

(Continued)

*Primary Examiner*—Kien Nguyen
(74) *Attorney, Agent, or Firm*—Christensen O'Connor Johnson Kindness PLLC

(57) ABSTRACT

A structure building system is described that utilizes a mat, a set of connectors and a set of structural members to build a structure. In a preferred embodiment, magnetic coupling/connection may be used to connect the piece of the structure together. The system may also have one or more pieces of material that may be draped over the structure.

15 Claims, 11 Drawing Sheets

U.S. PATENT DOCUMENTS 4,509,929 A 4/1985 Zawitz
4,556,391 A 12/1985 Tardivel et al.
4,561,549 A 12/1985 Yokohori
4,640,034 A 2/1987 Zisholtz
D288,829 S 3/1987 Cheuk-Sun
4,664,640 A 5/1987 Shindo et al.
4,702,719 A 10/1987 Lapid
4,719,549 A 1/1988 Apel
4,793,286 A * 12/1988 Buxton ..... 119/498
4,884,988 A 12/1989 McMurray
4,973,286 A 11/1990 Davison
4,984,380 A 1/1991 Anderson
5,038,812 A 8/1991 Norman
5,059,463 A 10/1991 Peters
5,069,623 A 12/1991 Peat
5,074,700 A 12/1991 Swoboda
5,076,520 A 12/1991 Bro
5,145,440 A 9/1992 Boris et al.
D339,173 S 9/1993 Marschak
5,250,002 A 10/1993 Kinberg
5,306,198 A 4/1994 Forman
5,337,772 A 8/1994 Habchi
5,352,149 A 10/1994 Melashenko et al.
5,360,028 A 11/1994 Jasin
5,370,570 A 12/1994 Harris
5,382,111 A 1/1995 Melashenko et al.
5,387,146 A 2/1995 Smith et al.
D359,869 S 7/1995 Oren
5,478,268 A 12/1995 Au
5,487,400 A 1/1996 Dawkins
5,525,088 A 6/1996 Mayne
D374,691 S 10/1996 Chow et al.
5,577,465 A * 11/1996 Cook ..... 119/498
5,645,464 A 7/1997 Chen
5,667,326 A 9/1997 McGaffigan
D387,814 S 12/1997 Chow et al.
5,761,852 A 6/1998 Liu
5,768,722 A 6/1998 Olson et al.
5,788,253 A 8/1998 Thomson et al.
5,803,786 A 9/1998 McCormick
5,846,114 A 12/1998 Frandsen, II
5,881,789 A 3/1999 Melashenko et al.
D408,192 S 4/1999 Chiang
5,928,054 A * 7/1999 Mast ..... 446/227
5,951,360 A 9/1999 Fearon et al.
5,964,533 A 10/1999 Ziglar
5,964,634 A 10/1999 Chang
5,971,188 A 10/1999 Kellogg et al.
5,993,287 A 11/1999 Melashenko et al.
6,004,182 A 12/1999 Pasin
6,066,022 A 5/2000 Fobean et al.
6,068,285 A 5/2000 Jackson et al.
6,071,174 A 6/2000 Yoon
6,113,455 A 9/2000 Whelan et al.
6,142,849 A 11/2000 Horton et al.
6,168,495 B1 1/2001 Yoon
6,199,229 B1 3/2001 Wong
6,203,395 B1 3/2001 McElhaney
6,257,263 B1 7/2001 Brereton
D450,516 S 11/2001 Darling et al.
D451,970 S 12/2001 Chan
6,325,086 B1 12/2001 Shinner et al.
6,332,824 B2 12/2001 Tell et al.
6,342,742 B1 * 1/2002 Kim ..... 310/81
6,491,563 B1 12/2002 Bailey
6,502,595 B2 1/2003 Louie
6,564,434 B1 * 5/2003 Morita ..... 24/303
6,568,981 B1 5/2003 Chang
6,626,727 B2 9/2003 Balanchi
6,647,669 B1 11/2003 Leitner
6,679,007 B1 1/2004 Minchew et al.
6,702,643 B1 * 3/2004 Drosendahl et al. ..... 446/227
6,739,567 B1 5/2004 Curtis
6,782,905 B2 * 8/2004 Chu et al. ..... 135/143
6,846,216 B1 1/2005 Balanchi
6,893,315 B2 5/2005 Barri
6,899,057 B1 5/2005 Chrisco et al.
6,966,813 B2 11/2005 Donahue
6,969,294 B2 11/2005 Vicentelli
2002/0115373 A1 8/2002 Lazerman
2002/0166304 A1 11/2002 Pareti
2002/0193046 A1 12/2002 Zebersky
2003/0213511 A1 11/2003 Louie
2004/0063380 A1 4/2004 Chi et al.
2004/0139680 A1 7/2004 Hambright
2004/0152393 A1 8/2004 Good
2004/0187903 A1 9/2004 Chu et al.
2004/0193680 A1 9/2004 Gibbs et al.
2004/0253902 A1 12/2004 Sinisi
2005/0118925 A1 6/2005 Kretzschmar
2005/0118926 A1 6/2005 Roger
2005/0124259 A1 6/2005 Tusacciu
2005/0159074 A1 7/2005 Kowalski et al.
2005/0159076 A1 7/2005 Kowalski et al.
2005/0164595 A1 7/2005 Toht et al.
2005/0197038 A1 9/2005 Tusacciu
2005/0217713 A1 10/2005 Chu et al.
2005/0245167 A1 11/2005 Sinisi
2006/0014468 A1 1/2006 Zawitz
2006/0264147 A1 11/2006 Shoptaugh

FOREIGN PATENT DOCUMENTS

JP 7-148354 A 6/1995
JP 9-84964 A 3/1997
JP 9-299620 A 11/1997

* cited by examiner

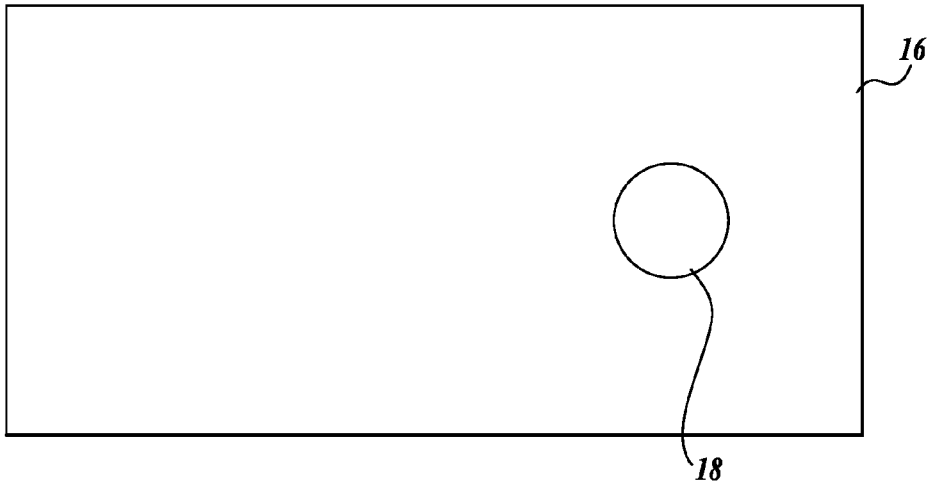
*Fig.1B1.*
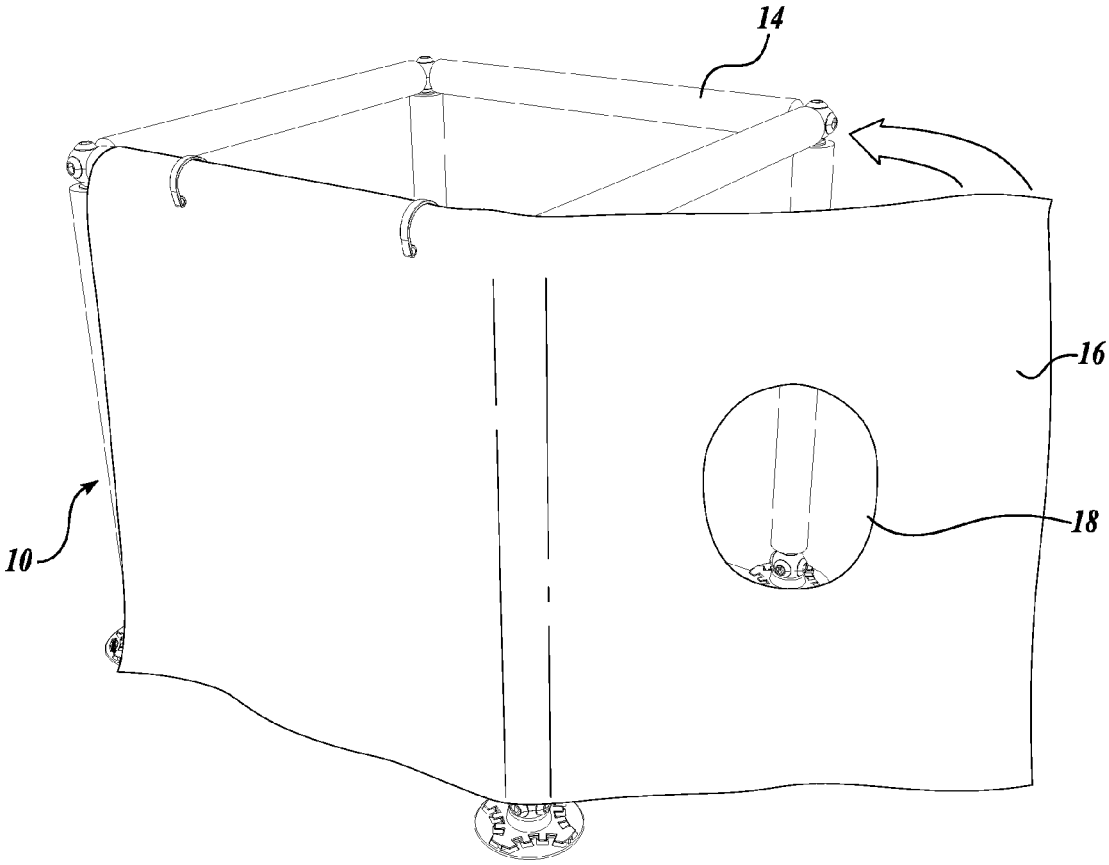
*Fig.1B2.*

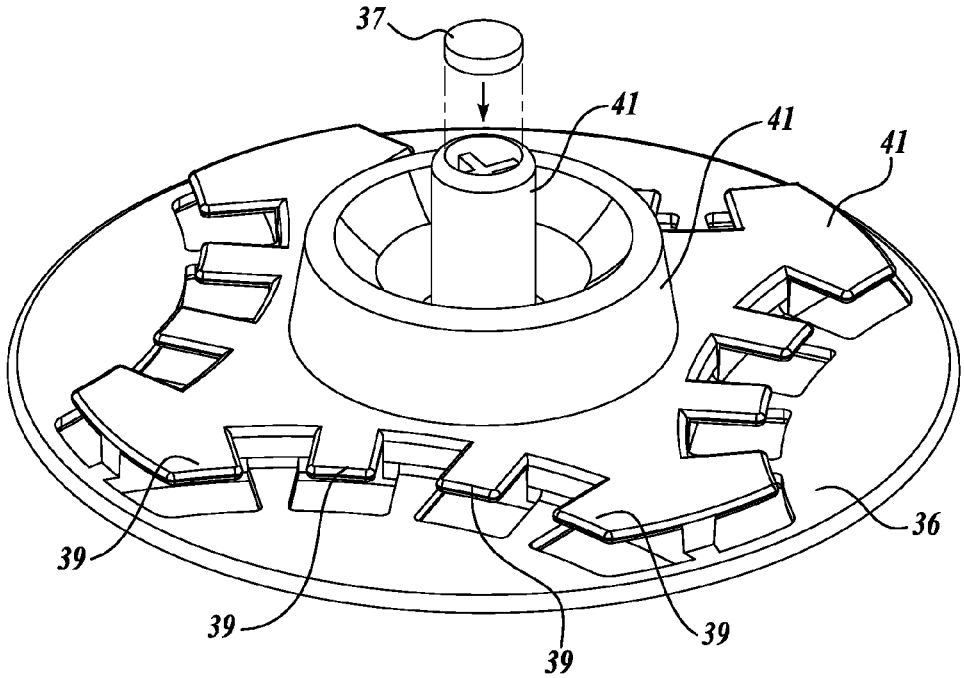
Fig.3A1.
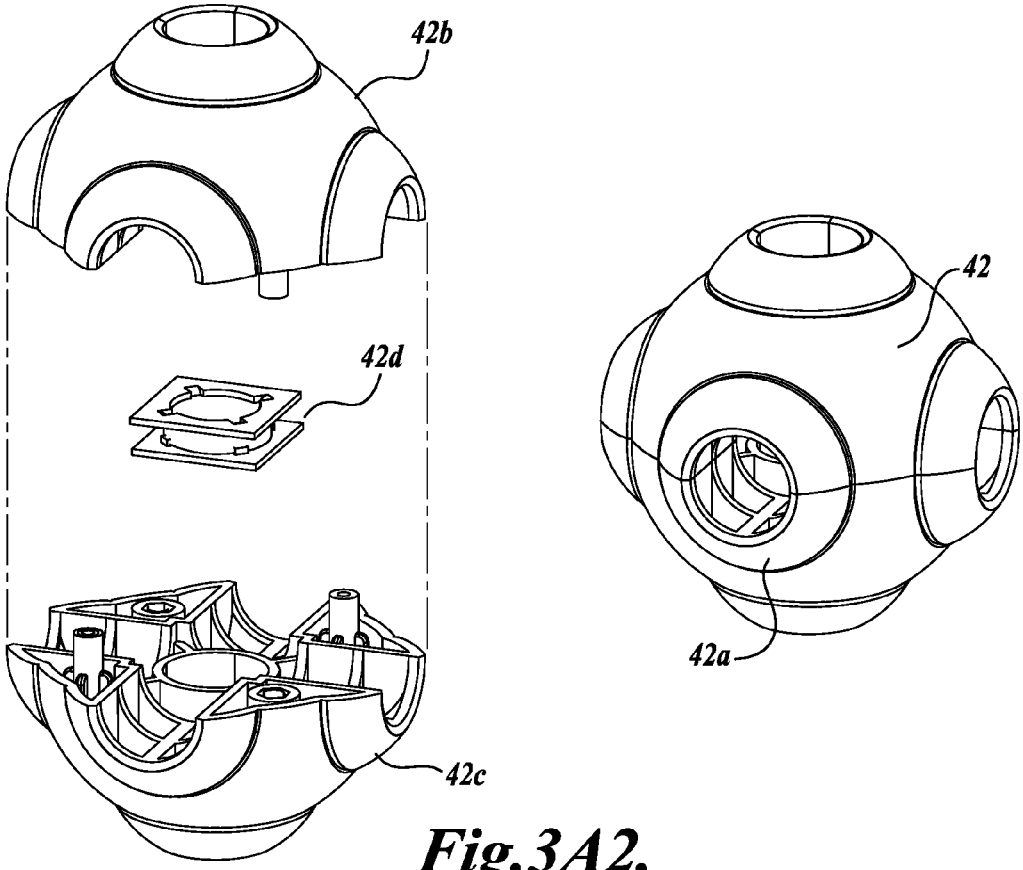
Fig.3A2.

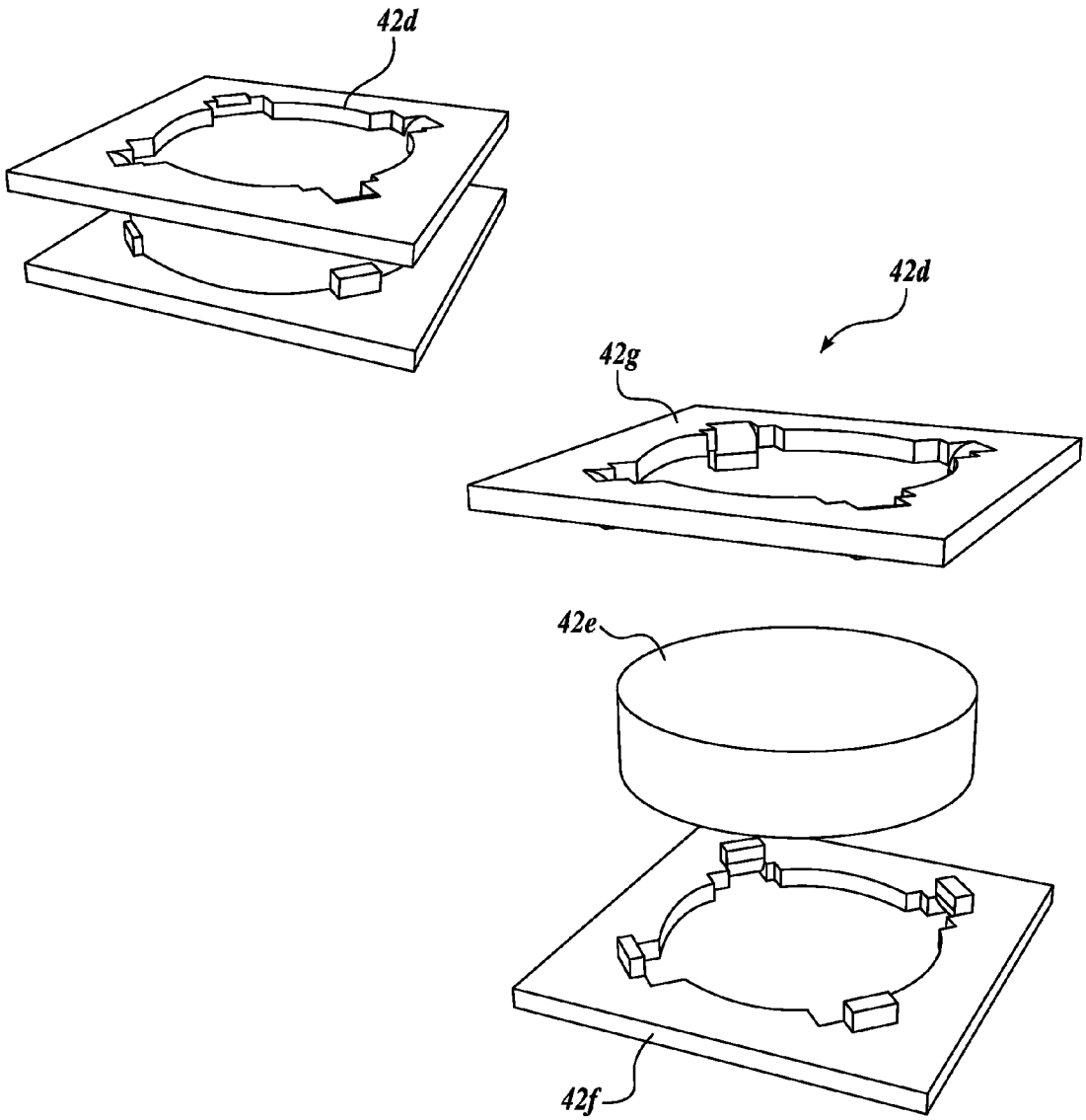
*Fig.3A3.*

A-A

STRUCTURE BUILDING TOY

PRIORITY CLAIM/RELATED APPLICATION

This application claims priority under 35 USC 119(e) to U.S. Provisional Patent Application Ser. No. 60/619,260 filed on Oct. 15, 2004 and entitled "Structure Building Toy" which is incorporated herein by reference.

FIELD OF THE INVENTION

The invention relates generally to a toy and in particular to a building toy.

BACKGROUND OF THE INVENTION

"Fort building" is a universally loved activity among kids of all ages. Typically, the child uses existing pieces of furniture, such as couches and chairs, and bed sheets as the building materials for the fort. The child then creates a fort space by draping the sheet(s) over the furniture so that a space is created. It is desirable to provide a toy that permits the child to expand his fort building capabilities into a variety of configurations. Thus, it is desirable to provide a superfort toy and it is to this end that the present invention is directed.

SUMMARY OF THE INVENTION

The structure building toy is an activity toy that allows kids to imagine and build structures, including but not limited to fort-like objects, boats, spaceships, submarines, castles and the like, that become vehicles or other play environments for escape into a land of pure creative fantasy. The structure building toy is unique in its use of a familiar material, such as foam noodles. Using the foam noodle as a 'building block' allows for tremendous freedom in construction, while being inexpensive, safe and fun. The structure building system includes innovative magnetic connectors that playfully assemble and disassemble the noodles with a satisfying click. The structure building system is designed to radically expand the creative potential of kids building spaces. The structure building toy may include innovative "landscape mats" which are bendable wire frames encased in fabric that fold out and may be connected together using base connectors. These landscape mats provide for additional stability for building larger structures as well as can be connected in a grid pattern to ease construction of certain structures. In an alternative embodiment, the landscape mat has floating metal disks, encapsulated between two layers of fabric wherein this embodiment of the landscape mat allows limitless possibilities for magnetic coupling to the floor and the landscape mat doubles as a roll-up storage system where all of the pieces can be inserted and simply stowed away. The structure building toy in accordance with the invention may also be used to build a structure without the landscape mat.

In order to fully catalyze a fantasy play experience, the structure building toy may include colorful fabric panel 'skins' to enclose the newly-created noodle space. The structure building toy may also have several of the fabric panels feature port holes with mesh so that children can look out of the port holes without easily being seen. Additionally, the mesh provides safety by preventing children from putting their heads through the port holes. In an alternative embodiment, the structure building toy may include multi-function 'port holes' that foster creative expression wherein the port holes may be made of a clear material and the structure building toy may come with a set of picture cards that can be slide into the window from the inside to customize the playscape and enhance the fantasy and "spy" experience. For example, the pictures may include a power reactor core, a view into space, an under sea view, submarine's periscope view, instrumentation panels etc. The clear vinyl windows can also act as a see-though pocket where pictures, drawings and precious items can be stored. The structure building toy may also have a solid/rigid panel that can be clipped onto the structure members.

Thus, a structure building apparatus is provided. The apparatus has one or more landscape mats having a plurality of connection areas to which a base connector can be connected. The apparatus also has a set of structural members that may be connected to any of the base connection areas and a set of connectors that couple the structural members to each other in order to build a structure using the mat, structural members and connectors. Further, the structure building system includes fabric that may be attached to the structural members in order to enclose spaces (or to create a wall of the structure) created by interconnected structural members and connectors.

BRIEF DESCRIPTION OF THE DRAWINGS

FIGS. 1B1 and 1B2 are diagrams illustrating a preferred embodiment of a port hole that is part of the structure building toy;

FIG. 3A1-3 are diagrams illustrating details of a set of connector devices that may be part of the structure building toy;

DETAILED DESCRIPTION OF A PREFERRED EMBODIMENT

The invention is particularly applicable to a structure building toy that uses the particular materials and connectors described below and it is in this context that the invention will be described. It will be appreciated, however, that the structure building in accordance with the invention has greater utility, since the structure building toy may use other elements including other structural elements and connectors and the structure building toy may be utilized for various applications other than building a fort for a child and these variations, such as building various other structures, are within the scope of the invention.

Figure 1A:
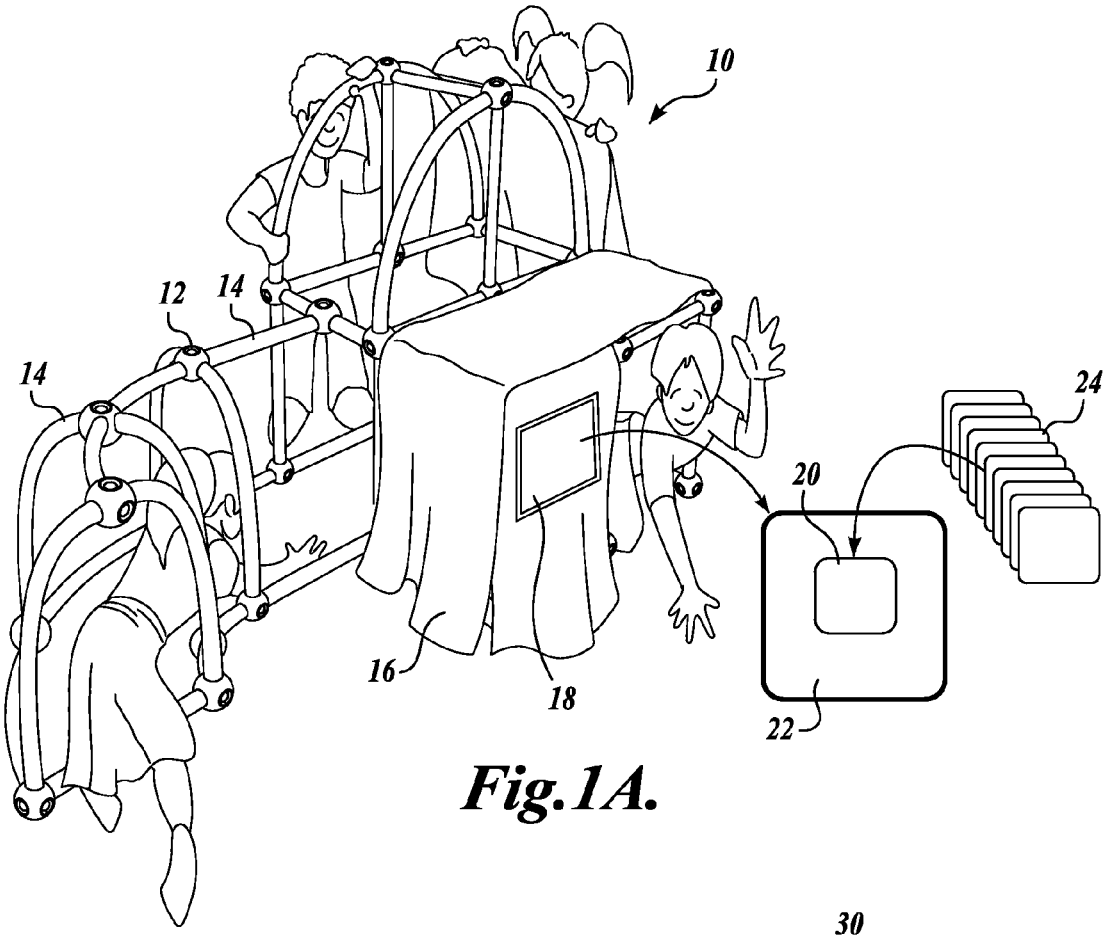
FIG. 1A is a diagram illustrating an embodiment of a structure building toy in accordance with the invention.
Figure 2B:
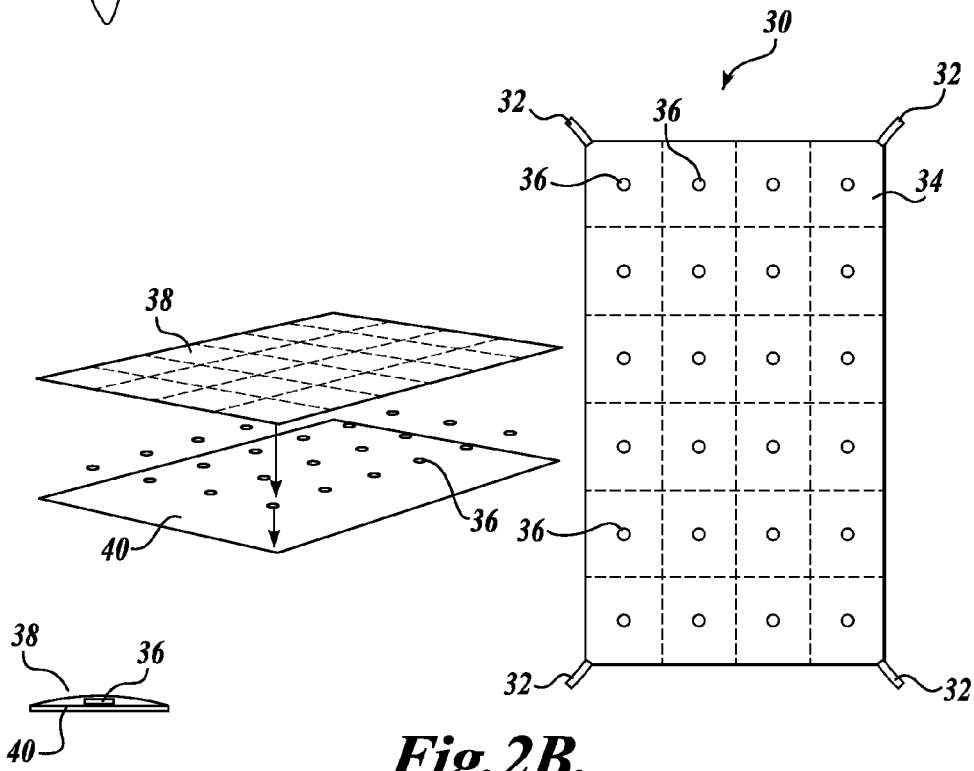
FIG. 2B is a diagram illustrating details of an example of an alternative embodiment of the landscape mat that may be part of the structure building toy.
Figure 2A:
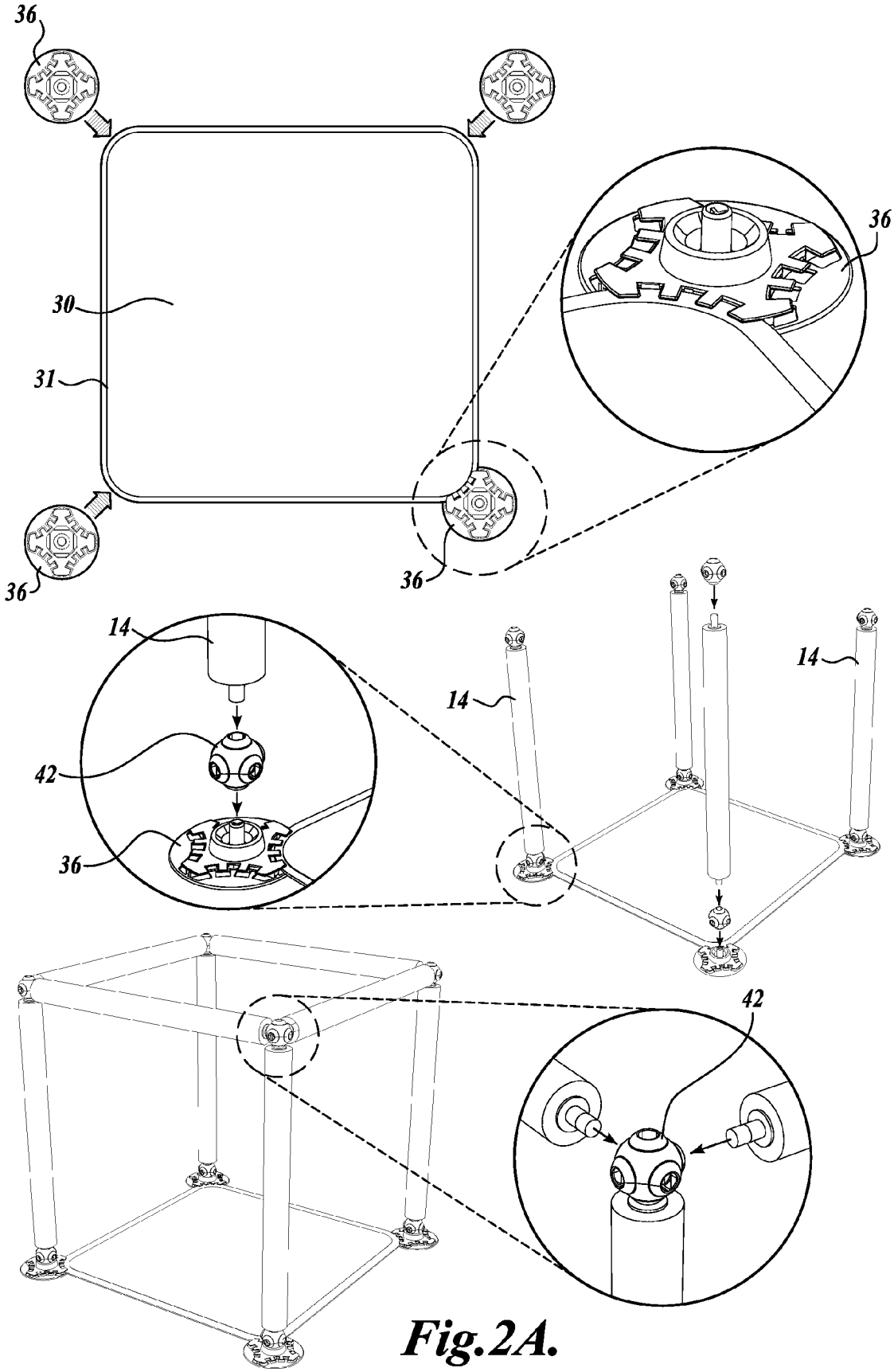
FIG. 2A is a diagram illustrating details of an exemplary landscape mat that may be part of the structure building toy.
Figure 4:
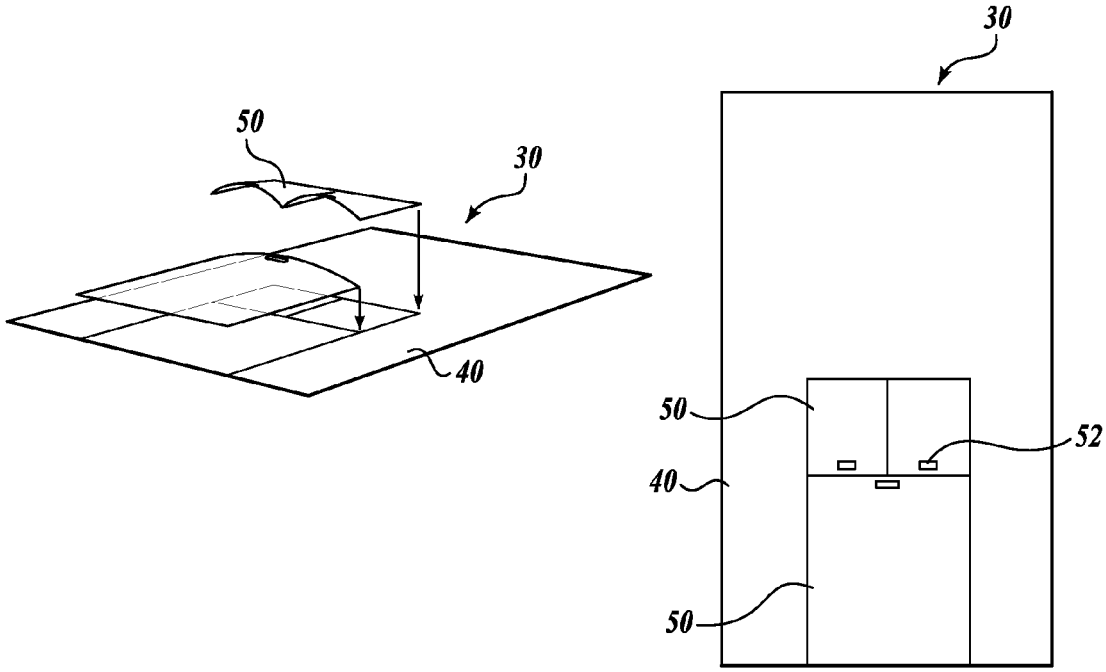
FIG. 4 is a diagram illustrating details of a bottom portion of the alternative embodiment of the landscape mat shown in FIG. 2B.

FIG. 1A is a diagram illustrating an embodiment of a structure building toy 10 in accordance with the invention. The structure building toy, in a preferred embodiment, is used to build a fort as shown in FIG. 1 although the structure building toy may be used to create various other structures that are within the scope of the invention. The structure may be built on a landscape mat (not shown) that has two different embodiments. The preferred embodiment of the landscape mat is shown in FIG. 2A while an alternative embodiment of the landscape mat is shown in FIGS. 2B and 4. In accordance with the invention, the structure may also be built without using the landscape mat. The structure may be built using one or more connectors 12 that connect one or more structural members 14 together and/or connect a structural member 14 to the mat as shown in more detail in FIGS. 6 and 7. Once the structure is created using the mat, connectors and structural members, a sheet 16 of material may be placed over the structural members to create the an internal space of the structure, such as the space on the interior of a fort. The sheets of material 16 may have different colors, patterns and fabrics to provide different fantasy experiences of the child. In one embodiment, each sheet of material may include a clip mechanism so that the sheet can be clipped onto the structural members. An example of a clip mechanism that may be used with the structure building system in accordance with the invention is described below with reference to FIGS. 9A-9D. The toy may be sold with one or more pieces of material 16 wherein some of the pieces of material may incorporate a port hole 18.

FIGS. 1B1 and 1B2 illustrates an preferred embodiment of the port hole 18 wherein the port hole 18 is formed in a sheet 16 wherein the port hole has mesh covering the port hole. The mesh allows the user to look out of the port holes without easily being seen and provides safety by preventing the users from putting their heads through the port holes. FIG. 1B2 shows the sheet 16 with the port hole 18 attached to one or more structural members in accordance with the invention.

In an alternative embodiment of the port hole 18 shown in FIG. 1A, the port hole 18 may further comprise a clear portion 20 and a skin portion 22 surrounding the clear portion. The port holes foster creative expression. When the alternate embodiment of the port hole 18 is used, the toy 10 may further comprise a set of picture cards 24 that can be slid into the clear portion 20 of the port hole 18 from the inside to customize the playscape and enhance the voyeur experience. For example, the set of pictures may include a set with view of the inside of an aircraft/helicopter in the air, a set for an outer space fantasy, a set for an underwater fantasy, a set for a castle/medieval fantasy and a set for a science fiction instrument panel. The clear portions 20 may also act as a see-thru pocket where pictures, drawings and precious items can be stored.

FIG. 2A is a diagram illustrating a preferred embodiment of a landscape mat 30 that may be used with the structure building toy 10. An alternative embodiment of the landscape mat 30 is shown in FIG. 2B and described below. The landscape mats shown in FIG. 2A or 2B may or may not be used to build a structure using the structure building toy 10. The landscape mats may provide additional stability for building larger structures as well as can be connected in a grid pattern to ease construction of certain structures. Returning to FIG. 2A, the preferred embodiment of the landscape mat 30 may be a bendable wire frame encased in fabric that fold out and may be connected together using base connectors 36. In a preferred embodiment, the toy 10 may have two landscape mats 30 wherein each landscape mat has a wire frame 31 is a 0.09375 inch thick formed spring steel wire and the fabric of the landscape mat is a 185T polyester fabric with a fire retardant treatment.

In order to use the landscape mat 30 shown in FIG. 2A, the user opens the landscape mat so that it is flat and then the user attaches a base connector 36 to each corner of the landscape mat 30 by sliding the corner of the landscape mat into the edge of the base connector 36. The corner of the landscape mat has rigidity due to the wire frame. The base connector has one or more pliable projections with ridges on the underside wherein the projections are positioned above a parallel platform of plastic so that a friction/pressure fit is achieved when the landscape mat is slid between the projection and the parallel platform. Next, a connector 42 is connected to the base connector 36 and then a structural member 14 may be connected to the connector 42. This process is repeated until the desired structure using the structural members 14 is formed. In this embodiment, the structure building toy may include a bag (with Velcro) into which the landscape mat (when folded up like a sunshade), the structural members and the remainder of the components may be transported and stored.

FIG. 2B is a diagram illustrating details of a top side of the alternative embodiment of the landscape mat 30 that is part of the structure building toy. The mat is the base of which the structure is built. The mat 30 may comprise one or more attachment mechanisms 32, such as Velcro tabs or a suction cup in a preferred embodiment, that secure the mat 30 to the surface on which the structure is to be constructed. The surface on which the structure may be constructed in typically a floor, but may also be a wall. FIG. 2B illustrates an example of the mat 30 having particular dimensions, but the mat is not limited to any particular size or shape. The mat 30 further comprises one or more connection points/areas 34 having a base connector mechanism 36 into which a structural member is connected. The mat may further comprise a top portion 38 and a bottom portion 40 wherein the base connector mechanisms 36 are located in between the top portion 38 and bottom portion 40 so that the base connector mechanisms 36 are relatively fixed with respect to each connection area 34. However, the base connector mechanisms may move within its connection area to provide an almost limitless number of variations on the position of the base connector. In a preferred embodiment, the top portion 38 may be a fine mesh material with perforated fabric and the bottom portion 40 may be fabric.

FIGS. 3A1-3 are diagrams illustrating details of a set of connector devices that may be part of the structure building toy. The set of connectors may include the base connector 36 and the six way connector 42. The base connector 36 may be made of an ABS material and may preferably include a metal tip portion 37 that fits into the base connector 36 as shown. The base connector may further include one or more projections 39 on each side of the base connector that are used to connect the landscape mat to the base connector. The base connector 36 may also have textured regions 41. As described above, the projections may have ridges on the underside so that the landscape mat is friction fit into the base connector.

As shown in FIG. 3A2, the connector 42 may connect up to six structural members or five structural members and the base connector 36 of the landscape mat. The connector 42 may be preferably made of an ABS material and have textured outer bumps 42*a*. In a preferred embodiment, the connector 42 may have an upper portion 42*b* and a lower portion 42*c* that are secured to each other (preferably by sonic welding) with a magnetic portion 42*d* within the interior of the connector.

FIG. 3A3 illustrates the magnetic portion 42*d* in more detail wherein the magnetic portion preferably comprises a magnet (preferably neodymium) 42*e* that is sandwiched between a first plate 42*f*, preferably stamped nickel-plated steel and a second plate 42*g*. Each plate may have a hole in the middle. The plates with the holes distribute the magnetic field of the magnet along the X, Y, and Z axes and the size and configuration of the hole controls the amount of the magnetic field that is redistributed along the Z axis. Thus, the combination of the magnet with the plates causes the magnetic field of the magnet to be redistributed to the edges of the plates so that the magnetic portion 42*d* provides a magnetic field that is distributed along the X, Y and Z axes.

Figure 3B:
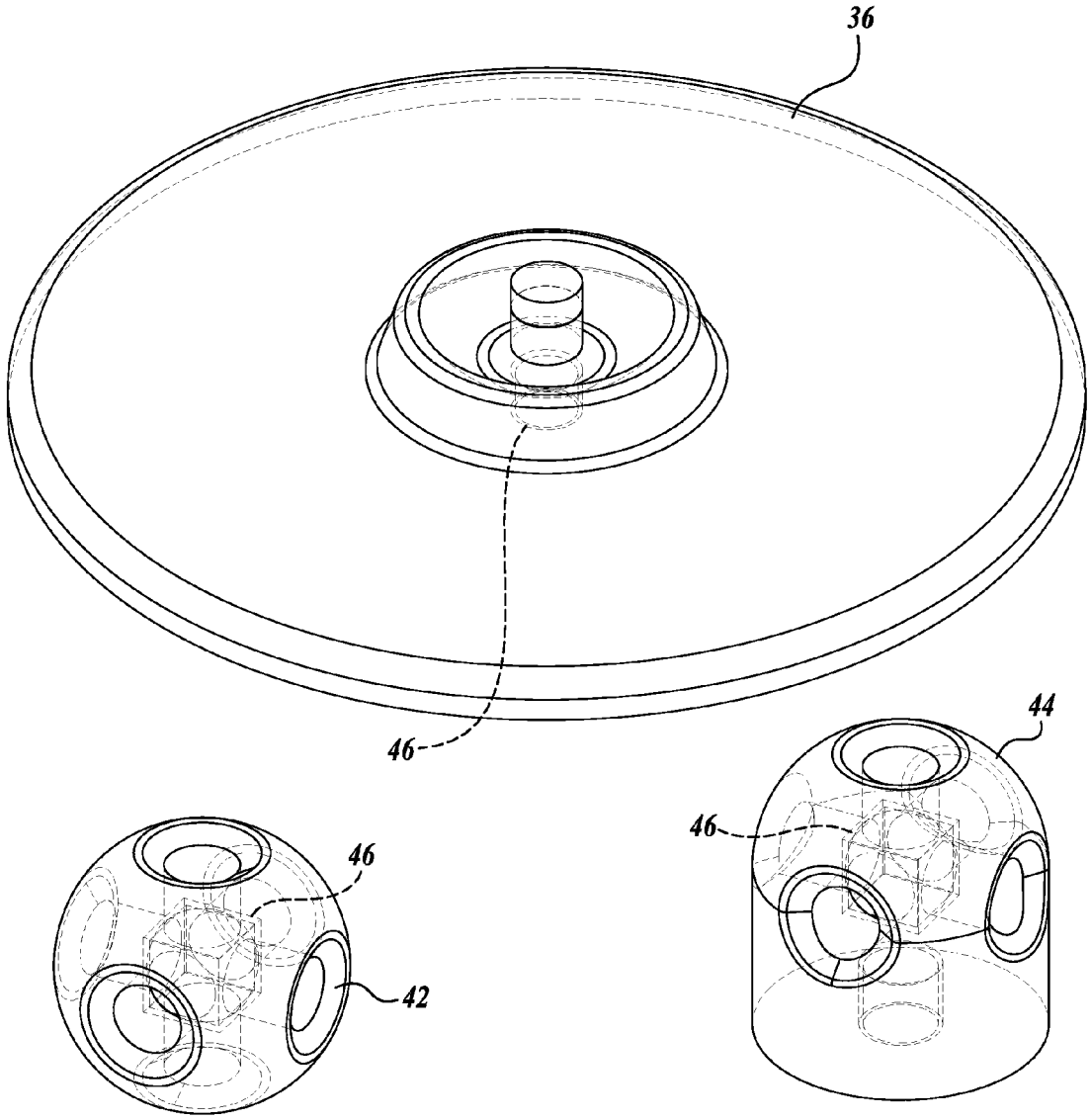
FIG. 3B is diagram illustrating details of an alternative embodiment of a set of connector devices that may be part of the structure building toy.

FIG. 3B is diagram illustrating details of an alternate embodiment for the set of connector devices that are part of the structure building toy. The structure building toy may be implemented using other or additional connector devices not described herein but that would be known alternative connectors that perform the same function as the connector devices shown. In particular, the set of connector devices may include the base connector mechanism 36, a six way connector mechanism 42 and a five way floor connector mechanism. More details of each of these mechanisms is described with reference to FIGS. 6, 7 and 8, respectively. Each connector in this alternative embodiment of the invention, has a magnet 46 captured within the connector to achieve the desired magnetic coupling. An exemplary magnet may be a neodymium magnet, but other types of magnets are within the scope of the invention. The base connector mechanism 36 is used to magnetically couple and attach a structural member to the mat, the six way connector mechanism 42 is used to connect up to six structural members to each other and the five way floor connector mechanism 44 is used to connect the mat and up to five structural members to each other. The alternative embodiment of the base connector mechanism 36 and the five way floor connector mechanism 44 may also have a magnet located at the bottom that connects these connectors to the alternative embodiment of the landscape mat. In this manner, the set of connectors provide the user with great flexibility in that a structural member may be connected to each other and to the mat in various different orientations. Furthermore, since the mat shown in FIG. 2B has a plurality of connection areas, the building structures that may be constructed using the toy 10 is almost limitless.

In the two embodiments described above, each connector may be a magnetic connector although other types of connectors, such as various types of mechanical connectors, are within the scope of the invention. For example, a mechanical connector or friction fit connector is also within the scope of the invention. As an example, the connector 42 may be a connector with four tubes wherein the diameter of each tube is slightly smaller than the diameter of the plastic tip of each structural member so that the plastic tip of a structural member may be inserted into the tube to create a friction fit between the structural member and the tube.

FIG. 4 is a diagram illustrating details of the bottom portion 40 of the alternative embodiment of the landscape mat 30 shown in FIG. 2B. A bottom surface of the mat 30 may have one or more storage units 50, such as pockets, into which some or all of the part of the toy, including the structural members and connectors may be stored. In a preferred embodiment, there may be one large pocket and two small pockets with Velcro closures 52. Alternatively, the storage units may hold the connectors only. Thus, the mat 30 also functions as a roll-up storage system where all of the pieces can be inserted and simply stowed away.

Figure 5:
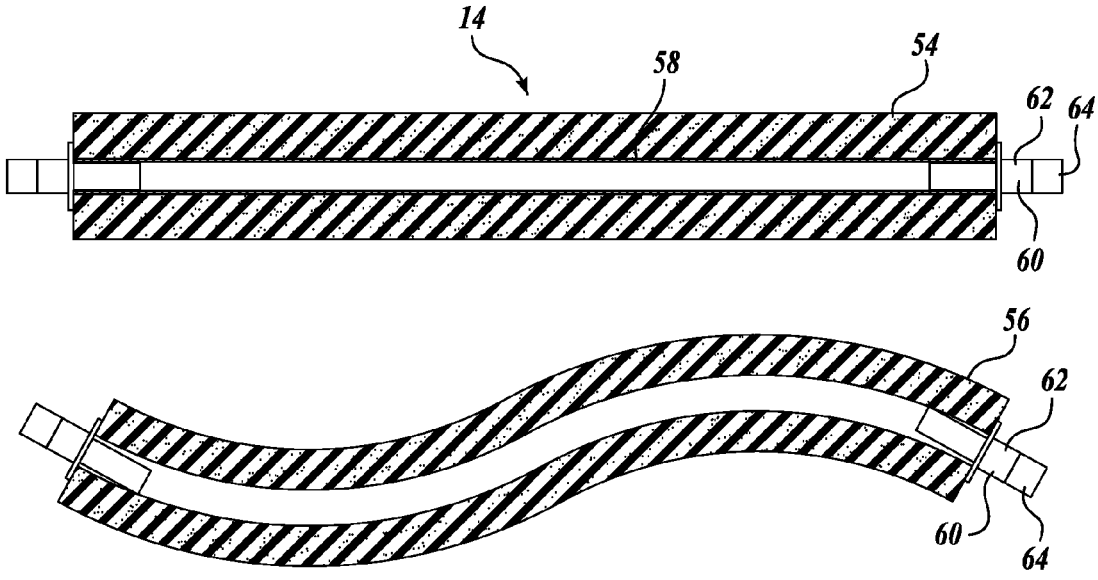
FIG. 5 is a diagram illustrating details of a structural member that may be part of the structure building toy.

FIG. 5 is a diagram illustrating details of the structural member 14 that is part of the structure building toy. In accordance with the invention, the structural member may include a rigid structural member 54 and a flexible structural member 56. In a preferred embodiment, the structural members may be made of a foam material, such as expanded polyethylene (EPE) foam that has good flexibility and limited memory so that the structural member returns to its original shape although other materials for the structural members are also within the scope of the invention. For example, each structural member may also be made out of rubber, injection molded plastic (ABS) or some form of metal. The rigid structural member 54 may include a rigid core 58, such as a plastic (ABS plastic tube) or a metal rod. The flexible structural member 56 does not have the rigid core. Each structural member further comprises a connector insert 60 that permits the structural member to be connected to the mat or other structural members using the connectors shown in FIG. 3. In a preferred embodiment, the connector insert 60 may include an insert 62 (that may be inserted into the end of the structural member), such as a plastic insert, with a magnetizable tip 64, such as a metal tip, so that the structural member may be magnetically coupled/connected to one of the connectors shown in FIG. 3. In some embodiments, the plastic insert may be made of an ABS plastic material and may be glued into the end of the structural member. In other embodiments, the plastic insert may be made of an ABS plastic material and may have a set of threads so that the plastic insert may be screwed into the end of the structural member.

Figure 6:
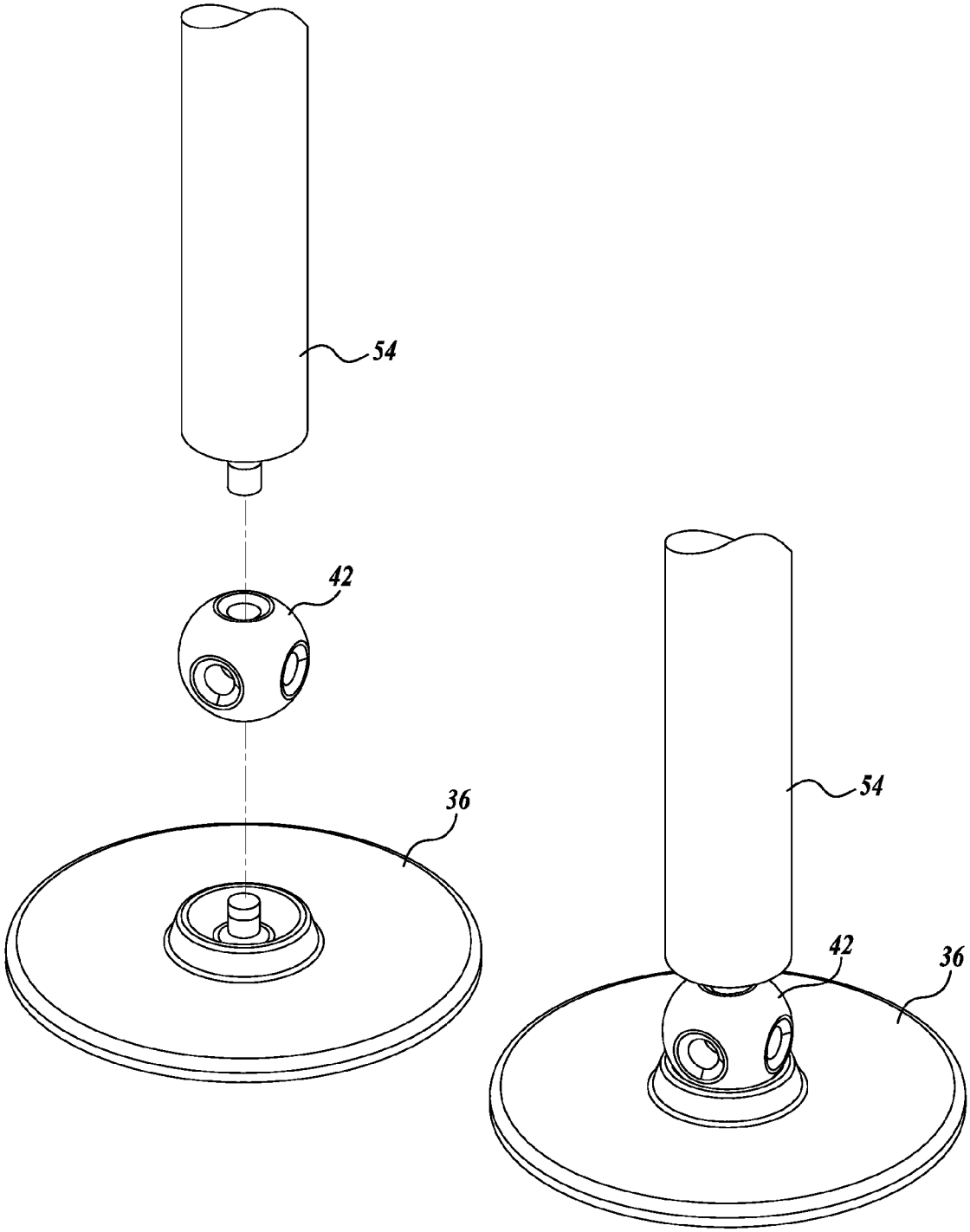
FIG. 6 is a diagram illustrating more details of the alternative embodiment of the base connector mechanism that may be part of the structure building toy.
Figure 7:
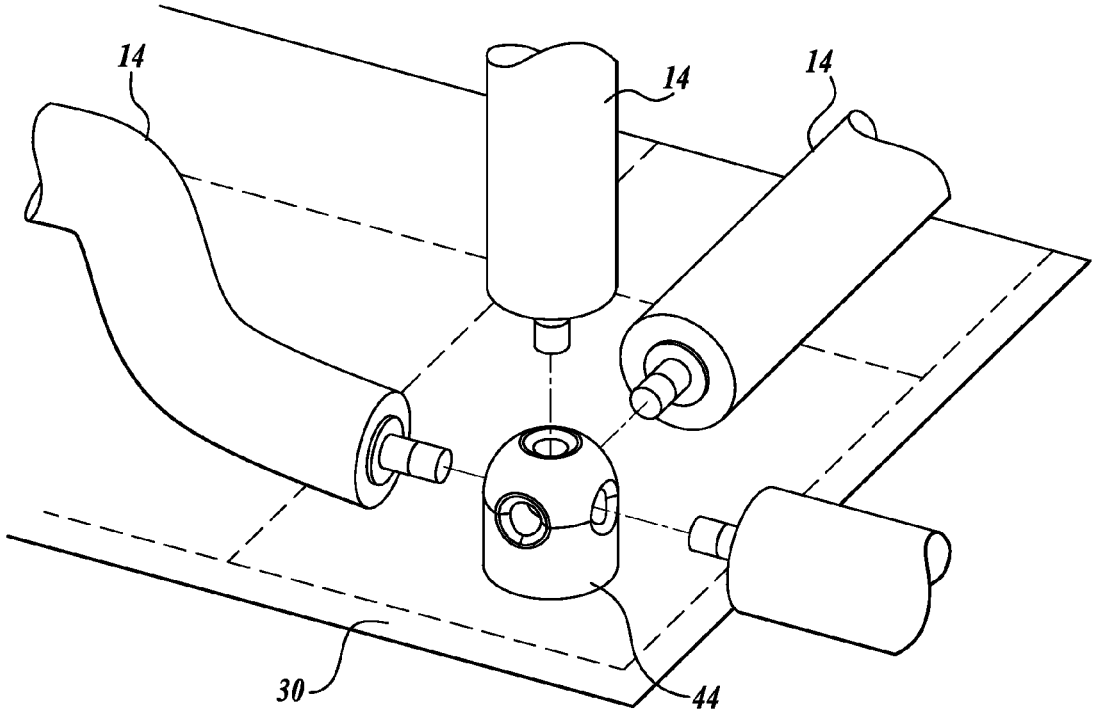
FIG. 7 is a diagram illustrating more details of an alternative embodiment of the five way floor connector mechanism that may be part of the structure building toy.
Figure 8:
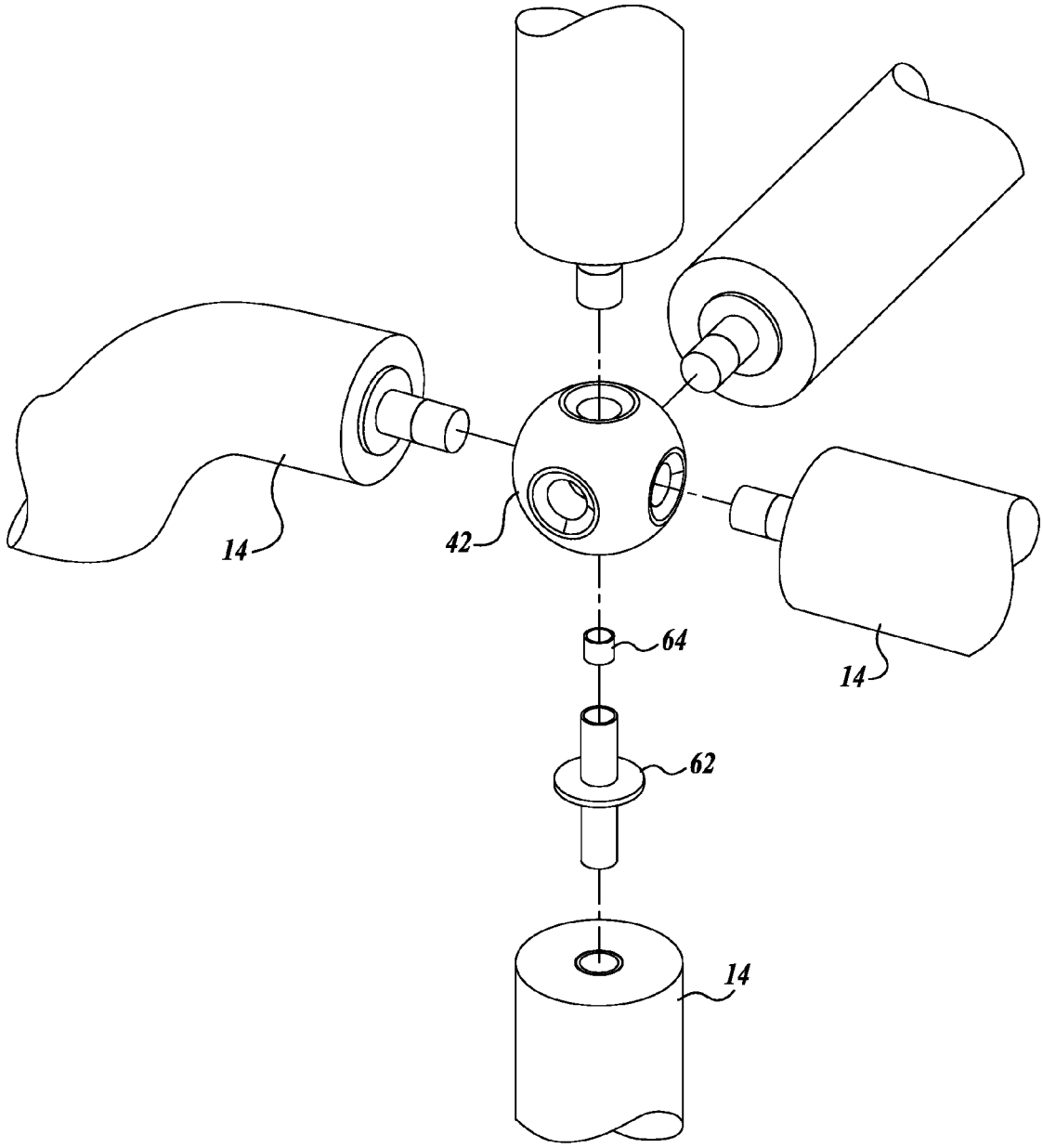
FIG. 8 is a diagram illustrating more details of the alternative embodiment of the six way connector mechanism that may be part of the structure building toy.

FIG. 6 is a diagram illustrating more details of the alternative embodiment of the base connector mechanism 36 that is part of the structure building toy. In the example shown in FIG. 6, the rigid structural member 54 is inserted into and magnetically coupled to the six way connector 42 which is in turn inserted into and magnetically coupled to the base connector mechanism 36. FIG. 7 is a diagram illustrating more details of the alternative embodiment of the five way floor connector mechanism 44 that is part of the structure building toy wherein the five way connector is magnetically coupled to the mat 30 and one or more structural members 14 as shown. FIG. 8 is a diagram illustrating more details of the alternative embodiment of the six way connector mechanism 42 that is part of the structure building toy wherein the six way connector mechanism is magnetically coupled to one or more structural members 14 that have the insert 62 and the magnetizable tip 64.

For the preferred embodiment of the invention that uses the landscape mat 30 shown in FIG. 2A, the structure building toy provides many advantages. For example, the landscape mat 30 shown in FIG. 2A gives a good foundation for the structure since the base connectors are hard to tip over since they have a wide bottom and a low center of gravity. In addition, since the base connectors are connected to the corners of the landscape mat 30, the mat stabilizes the base connectors. The landscape mat 30 shown in FIG. 2A also helps the user to start a structure since it often hard for a user to start building without some starting point. The landscape 30 shown in FIG. 2A can also be connected together to create a variety of base layouts.

For the alternative embodiment of the structure building toy 10 that uses the landscape mat shown in FIG. 2B, the structure building toy provides many advantages. For example, the mat allows for true "analog" structure. Most typical construction systems have a rigid "grid" of some kind that is imposed upon the child. Lego is an example of a typical system in that, once the first brick is set down, all other brick possibilities are pre-determined. Unlike these typical systems, each structural member of the structure building toy has truly infinite movement, and therefore all subsequent pieces can actually occupy any place so that there is no limit to what can be constructed using the inventive system. Furthermore, since the structural members of the construction system are flexible, the structural members can be used to create both rectilinear and organic constructions (frame based, or curved/circular). In addition, the mat may be used on any 2 dimensional surface including the floor, wall or any other surface. The clip system allows for pre cut pieces of fabric 16 with simple geometries to form fit to an infinite number of construction shapes.

The structural members in accordance with the invention are both flexible, but also sufficiently rigid to form a connection point. In a preferred embodiment, each structural member has a flexible foam member with a solid mechanical joint at each end. In a preferred embodiment, the solid mechanical joint is a plastic tip with a metal tip that enables the structural members to be magnetically coupled. In accordance with the invention, the mechanical coupling may also be a friction or interference (snap) fit. As described above, the mat has the base connectors encapsulated in the mat so that the base connectors can slide around within their quadrants and enable a nearly infinite number of floor coupler positions. The mat may also be used as a storage bag and the mat can be affixed (Velcro, suction cups) to the floor. The windows in the material may be used as pockets for interchangeable images to help decorate the inside of the space. (i.e.; if the kid builds a helicopter, the image in the window looks like she is peering out of the window from the cockpit.

Figure 9C:
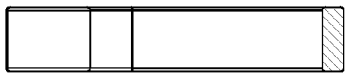
FIG. 9A-D are diagrams illustrating an example of a clip mechanism of the structure building toy.
Figure 9A:
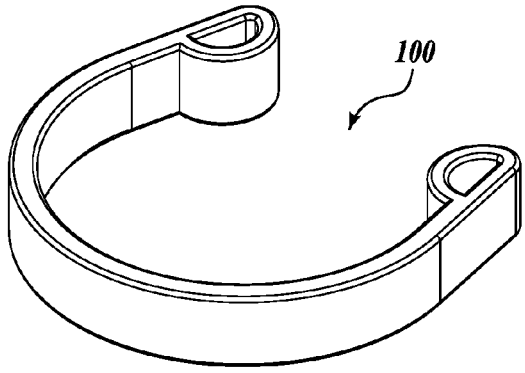
Figure 9B:
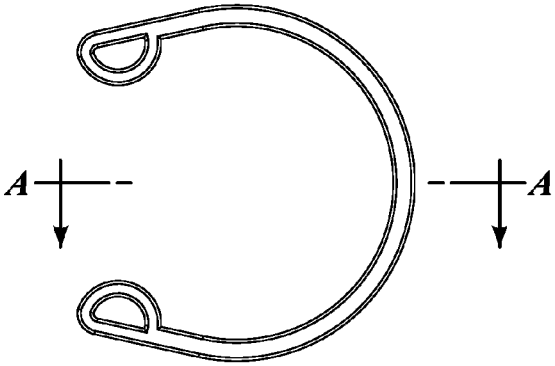
Figure 9D:
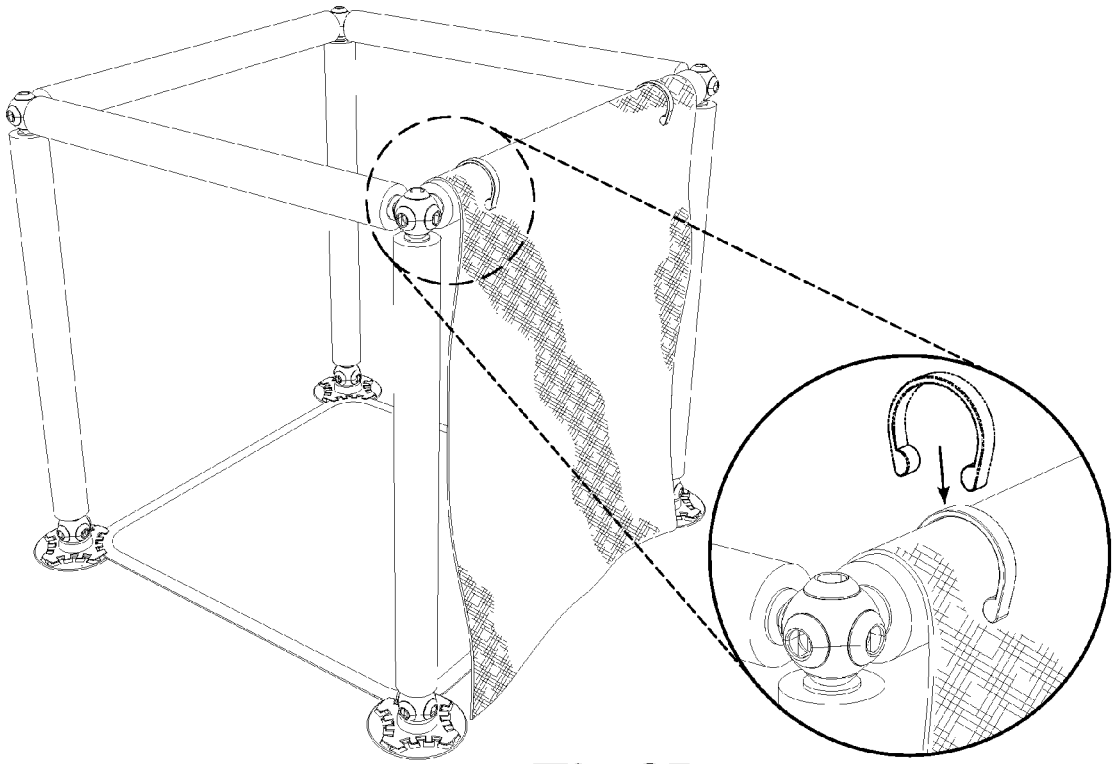

FIG. 9A-D are diagrams illustrating an example of a clip mechanism of the structure building toy. A clip mechanism 100 is a resilient material so that it can be attached around a structural member to secure a piece of fabric to the structural members as shown in FIG. 9D wherein the fabric/sheet may be laid over the structural member and then the clip mechanism is slid over the fabric/sheet and structural member to hold the sheet on the structural member. FIGS. 9B and 9C show the clip mechanism in a top view and sectional view along line A-A. In a preferred embodiment, the clip mechanism may be injection molded polypropylene. FIGS. 9B and 9C illustrate the dimensions of a preferred embodiment of the clip mechanism. In accordance with the invention, the clip mechanism may be implemented using other known techniques for attaching a piece of fabric/sheet to a structural member and those other known techniques are within the scope of the invention.

While the foregoing has been with reference to a particular embodiment of the invention, it will be appreciated by those skilled in the art that changes in this embodiment may be made without departing from the principles and spirit of the invention, the scope of which is defined by the appended claims.

The invention claimed is:

1. A structure building apparatus, comprising:

a mat having a plurality of connection areas with each connection area having a region for connection of a base connector to the connection area, the base connector including one or more pliable projections positioned above a parallel platform so that a friction fit is achieved when any of the connection areas of the mat is disposed therebetween;

a set of structural members that may be connected to any of the connection areas of the mat;

a set of connectors that couple the structural members to each other in order to build a structure using the mat, structural members and connectors; and wherein each structural member further comprises a connector mechanism at each end of the structural member and wherein the connector mechanism is inserted into the connector to connect the structural member to the connector.

2. The apparatus of claim 1, wherein the base connector and the set of connectors are magnetic connectors.

3. The apparatus of claim 2, wherein each magnetic connector further comprises a magnet sandwiched between a first plate and a second plate so that a magnetic field of the magnet is distributed.

4. The apparatus of claim 3, wherein the magnet further comprises a neodymium magnet.

5. The apparatus of claim 1, wherein each structural member further comprises a flexible region and a mechanical joint at each end of the flexible region.

6. The apparatus of claim 1, wherein each structural member snap fits into each connector.

7. The apparatus of claim 1, wherein the set of structural members are selected from one of a rigid structural member having a rigid core and a flexible structural member.

8. The apparatus of claim 1, wherein each structural member is made of foam.

9. The apparatus of claim 1, wherein the connector mechanism further comprises an insert portion that is inserted into the structural member and a tip portion that is insertable into the connector.

10. The apparatus of claim 1 further comprising a sheet of material that may be placed over the structure to create an interior space of the structure.

11. The apparatus of claim 10, wherein the sheet of material further comprises a porthole.

12. A structure building apparatus comprising:

a mat having a plurality of connection areas with each connection area having a region for connection of a base connector to the connection area, the base connector including one or more pliable projections positioned above a parallel platform so that a friction fit is achieved when any of the connection areas of the mat is disposed therebetween;

a set of structural members that may be connected to any of the connection areas of the mat; and a set of connectors that couple the structural members to each other in order to build a structure using the mat, structural members and connectors;

wherein the set of connectors further comprises one of the base connector, a six way connector connecting up to six structural members to each other and a five way connector connecting one or more structural members to the mat.

13. A structure building apparatus, comprising:

a mat having a plurality of connection areas with each connection area having a region for connection of a base connector to the connection area, the base connector including one or more pliable projections positioned above a parallel platform so that a friction fit is achieved when any of the connection areas of the mat is disposed therebetween;

a set of structural members that may be connected to any of the connection areas of the mat;

a set of connectors that couple the structural members to each other in order to build a structure using the mat, structural members and connectors;

a sheet of material having a porthole that may be placed over the structure to create an interior space of the structure; and one or more picture cards positionable in the porthole to customize an environment of the structure.

14. The apparatus of claim 13, wherein the picture cards are selected from one of an interior of an aircraft picture card, an outer space fantasy card, an underwater fantasy card, a medieval environment card and a science fiction instrument card.

15. A structure building apparatus, comprising:

a mat having a plurality of connection areas with each connection area having a region for connection of a base connector to the connection area, the base connector including one or more pliable projections positioned above a parallel platform so that a friction fit is achieved when any of the connection areas of the mat is disposed therebetween;

a set of structural members that may be connected to any of the connection areas of the mat;

a set of connectors that couple the structural members to each other in order to build a structure using the mat, structural members and connectors; and a sheet of material having a porthole that may be placed over the structure to create an interior space of the structure;

wherein the porthole further comprises a mesh porthole.

* * * * *